US011131510B1

(12) United States Patent
Cheng et al.

(10) Patent No.: US 11,131,510 B1
(45) Date of Patent: Sep. 28, 2021

(54) HEAT PIPE STRUCTURE

(71) Applicants: Inventec (Pudong) Technology Corporation, Shanghai (CN); INVENTEC CORPORATION, Taipei (TW)

(72) Inventors: Yi-Lun Cheng, Taipei (TW); Chih-Kai Yang, Taipei (TW); Meng-Lung Chiang, Taipei (TW)

(73) Assignees: Inventec (Pudong) Technology Corporation, Shanghai (CN); INVENTEC CORPORATION, Taipei (TW)

( * ) Notice: Subject to any disclaimer, the term of this patent is extended or adjusted under 35 U.S.C. 154(b) by 37 days.

(21) Appl. No.: 16/820,745

(22) Filed: Mar. 17, 2020

(30) Foreign Application Priority Data

Mar. 4, 2020 (CN) ..... 202010144082.2

(51) Int. Cl.
*F28D 15/02* (2006.01)
*F28F 5/00* (2006.01)
*F28D 21/00* (2006.01)

(52) U.S. Cl.
CPC ..... *F28D 15/0275* (2013.01); *F28F 5/00* (2013.01); *F28D 2021/004* (2013.01)

(58) Field of Classification Search
CPC .. F28D 15/0275; F28D 15/0208; F28D 11/02; F28F 5/00; F28F 2280/10; F28F 2280/105
See application file for complete search history.

(56) References Cited

U.S. PATENT DOCUMENTS 4,345,642 A * 8/1982 Ernst ..... F28D 15/0275 165/104.14
5,796,581 A * 8/1998 Mok ..... G06F 1/203 165/104.33
5,847,925 A * 12/1998 Progl ..... G06F 1/203 361/679.47
6,097,596 A * 8/2000 Cipolla ..... G06F 1/203 16/223
6,125,035 A * 9/2000 Hood, III ..... G06F 1/203 361/679.47
6,185,102 B1 * 2/2001 Shou ..... G06F 1/203 16/223
6,253,836 B1 * 7/2001 Mitchell ..... F28D 15/0233 165/104.33
9,332,675 B2 * 5/2016 Hsieh ..... H05K 7/20336
10,352,546 B2 * 7/2019 Mochizuki ..... F21S 45/47
10,775,842 B1 * 9/2020 Peng ..... G06F 1/1683
10,932,393 B2 * 2/2021 Paavola ..... G06F 1/203
2007/0034355 A1 * 2/2007 Kuo ..... F28D 15/0275 165/80.4
2009/0279262 A1 * 11/2009 Huang ..... G06F 1/203 361/704

(Continued)

*Primary Examiner* — Jon T. Schermerhorn, Jr.
(74) *Attorney, Agent, or Firm* — CKC & Partners Co., LLC

(57) ABSTRACT

A heat pipe structure is used for cooling a heat source. The heat pipe structure includes a sleeve tube and a shaft. The sleeve tube includes an inner wall. The sleeve tube has a trench on the inner wall. The trench is at an outlet end of the sleeve tube. The trench extends in a circumferential direction of the sleeve tube. The shaft is connected to the heat source. The shaft is inserted into the sleeve tube from the outlet end such that the shaft is rotatable relative to the sleeve tube. The trench surrounds the shaft.

8 Claims, 4 Drawing Sheets

(56) References Cited

U.S. PATENT DOCUMENTS

| | | | | |
|---|---|---|---|---|
| 2010/0163213 | A1* | 7/2010 | Xu | H01L 23/427 165/104.26 |
| 2012/0160457 | A1* | 6/2012 | Kim | F28D 15/0275 165/104.26 |
| 2019/0301813 | A1* | 10/2019 | Liao | F28D 15/0233 |
| 2020/0259231 | A1* | 8/2020 | Omi | B60K 11/02 |
| 2020/0378689 | A1* | 12/2020 | Peng | F28D 15/0233 |

* cited by examiner

HEAT PIPE STRUCTURE

RELATED APPLICATIONS

This application claims priority to China Application Serial Number 202010144082.2, filed Mar. 4, 2020, which are herein incorporated by reference.

BACKGROUND

Field of Disclosure

The present invention is related to a heat pipe structure.

Description of Related Art

For a traditional rotating shaft structure, an O-ring is used to seal a gap of the rotating shaft structure in order to avoid the leakage of lubricating fluid. However, there is friction between the O-ring and the rotating shaft, and the rotating shaft structure is easily damage because of the insufficient rigidity.

A heat pipe is used to conduct heat. The heat pipe is usually made of a material with great thermal conductivity, and heat pipe is in contact with a heat source to dissipate heat. Since the overall structural strength of the heat pipe is limited for the purpose of heat dissipation, it is not convenient to use an O-ring for sealing when the heat pipe is fixed in contact with the heat source.

Accordingly, how to provide a solution to solve the aforementioned problems becomes an important issue to be solved by those in the industry.

SUMMARY

To achieve the above object, an object of the present invention is to provide a heat pipe structure that does not damage heat pipe itself while maintaining contact with the shaft connected to the heat source and keeping the heat pipe internally sealed.

One aspect of the present invention is related to a heat pipe structure used for cooling a heat source. The heat pipe structure includes a sleeve tube and a shaft. The sleeve tube includes an inner wall. The sleeve tube has a trench on the inner wall. The trench is at an outlet end of the sleeve tube. The trench extends in a circumferential direction of the sleeve tube. The shaft is connected to the heat source. The shaft is inserted into the sleeve tube from the outlet end such that the shaft is rotatable relative to the sleeve tube. The trench surrounds the shaft.

In one or more embodiments of the present invention, the sleeve tube is hollow. The sleeve tube further includes an outer wall. The inner wall and the outer wall define a chamber for accommodating a heat transfer fluid.

In one or more embodiments of the present invention, the trench is connected to the inner wall by a first peripheral edge and a second peripheral edge. The second peripheral edge is closer to the outlet end than the first peripheral edge. The first peripheral edge and the second peripheral edge are parallel to each other and extend along a circumferential direction of the sleeve tube. The trench is recessed between the first peripheral edge and the second peripheral edge.

In some embodiments, the trench includes an inclined surface, and the inclined surface extends at an angle from one of the first peripheral edge and the second peripheral edge.

In some embodiments, the trench further includes a vertical surface. The vertical surface is perpendicular to the inner wall. The inner wall extends from one of the first peripheral edge and the second peripheral edge, and the vertical surface and the inclined surface form the trench.

In some embodiments, the heat pipe structure further includes a lubricating layer between the trench and the shaft. The lubricating layer fills a gap between the shaft and the sleeve tube to seal the inside of the sleeve tube.

In some embodiments, a part of the lubricating layer is accommodated in the trench and in contact with the shaft. Another part of the lubricating layer is located between the shaft and a part of the inner wall outside the trench.

In some embodiments, the lubricating layer has a first liquid surface and a second liquid surface. The first liquid surface is opposite to the second liquid surface. The first liquid surface and the second liquid surface have edges connected to the shaft. The first liquid surface is located between the inner wall outside the trench and the shaft. The second liquid surface is located between the inclined surface and the shaft.

In some embodiments, the inclined surface is configured to extend from the second peripheral edge toward the first peripheral edge. The second liquid surface is configured to protrude toward the outlet end. The first liquid surface is configured to protrude along a direction opposite to the outlet end.

In some embodiments, the inclined surface is configured to extend from the first peripheral edge toward the second peripheral edge. Both the first liquid surface and the second liquid surface are recessed toward the inside of the lubricating layer.

In summary, for the heat pipe structure of the present invention, the inner wall of the sleeve tube has a circumferentially extending trench. The trench has an inclined surface, and the lubricating layer can be filled between the trench on the inner wall and the shaft connected to the heat source. The lubricating layer can seal the inside of the sleeve tube without damaging the heat pipe structure due to capillary force.

It is to be understood that both the foregoing general description and the following detailed description are by examples, and are intended to provide further explanation of the invention as claimed.

BRIEF DESCRIPTION OF THE DRAWINGS

In order to make the above and other objects, features, advantages, and embodiments of the present invention more comprehensible, the description of the drawings is as follows.

DETAILED DESCRIPTION

The following embodiments are disclosed with accompanying diagrams for detailed description. For illustration clarity, many details of practice are explained in the following descriptions. However, it should be understood that these details of practice do not intend to limit the present invention. That is, these details of practice are not necessary in parts of embodiments of the present invention. Furthermore, for simplifying the drawings, some of the conventional structures and elements are shown with schematic illustrations. Also, the same labels may be regarded as the corresponding components in the different drawings unless otherwise indicated. The drawings are drawn to clearly illustrate the connection between the various components in the embodiments, and are not intended to depict the actual sizes of the components.

In addition, terms used in the specification and the claims generally have the usual meaning as each terms are used in the field, in the context of the disclosure and in the context of the particular content unless particularly specified. Some terms used to describe the disclosure are to be discussed below or elsewhere in the specification to provide additional guidance related to the description of the disclosure to specialists in the art.

Phrases "first," "second," etc., are solely used to separate the descriptions of elements or operations with same technical terms, not intended to be the meaning of order or to limit the invention.

Secondly, phrases "comprising," "includes," "provided," and the like, used in the context are all open-ended terms, i.e. including but not limited to.

Further, in the context, "a" and "the" can be generally referred to one or more unless the context particularly requires. It will be further understood that phrases "comprising," "includes," "provided," and the like, used in the context indicate the characterization, region, integer, step, operation, element and/or component it stated, but not exclude descriptions it stated or additional one or more other characterizations, regions, integers, steps, operations, elements, components and/or groups thereof.

Figure 1:
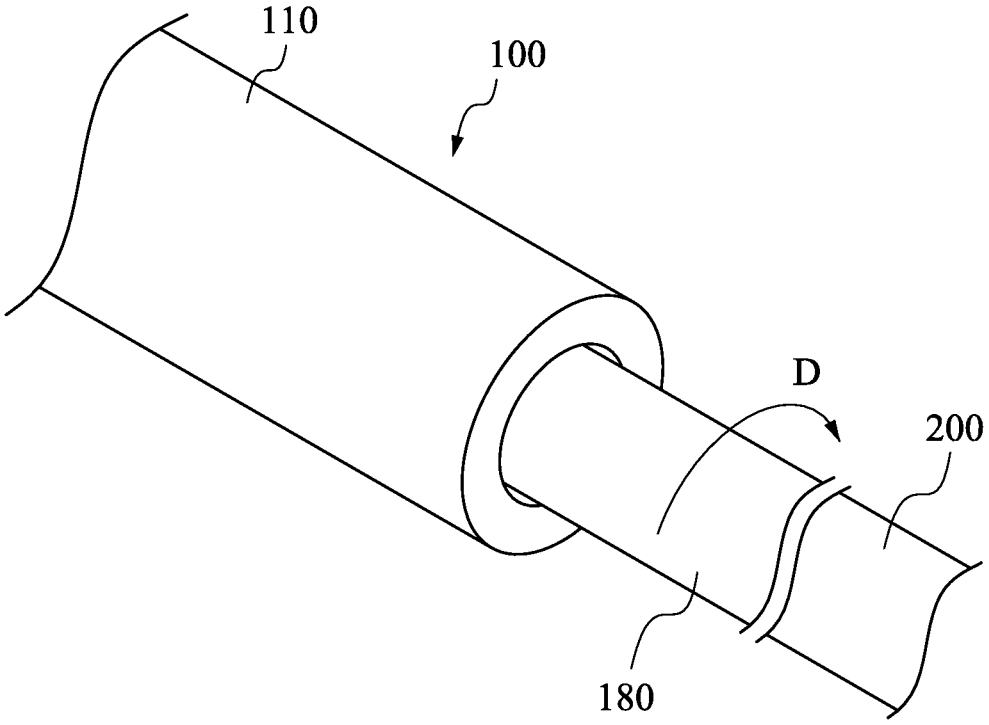
FIG. 1 is a perspective view of a sleeve tube of a heat pipe structure inserted by a shaft connected to a heat source according to one embodiment of the present invention.

Please refer to FIG. 1. FIG. 1 is a perspective view of a sleeve tube 110 of a heat pipe structure 100 inserted by a shaft 180 connected to a heat source 200 according to one embodiment of the present invention. The heat pipe structure 100 includes a sleeve tube 110 and a shaft 180 connected to the heat source. The shaft 180 inserts into the sleeve tube 110 of the heat pipe structure 100 from an outlet end of the sleeve tube 110. For example, the shaft 180 connected to the heat source 200 is one end of a heat conduction pipe. The heat conduction pipe can be a metal tube made by Cooper with good thermal conductivity, and the heat conduction pipe can be used to conduct heat generated by heat source. Therefore, the shaft 180 is inserted into the sleeve tube 110 from the outlet end such that the shaft 180 is rotatable relative to the sleeve tube 110, and the shaft 180 can be configured inside the sleeve tube 110 and rotate in a circumferential direction D of the sleeve tube 110. In other words, the shaft 180 connected to the heat source 200 and the sleeve tube 110 form a rotating shaft structure. This allows the shaft 180 connected to the heat source 200 to have a degree of freedom of rotation at the connection point with the heat pipe structure 100, which can be combined with other rotating shaft devices of an electronic device.

Figure 2:
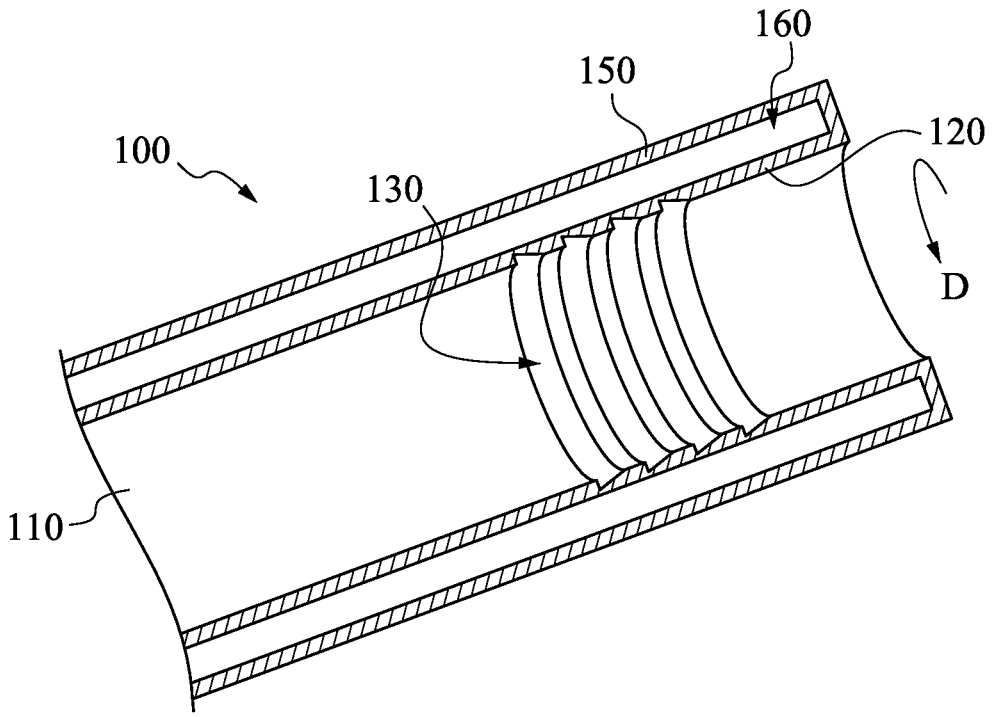
FIG. 2 is a cross-section of a sleeve tube of a heat pipe structure according to one embodiment of the present invention.

Please refer to FIG. 2. FIG. 2 is a cross-section of a sleeve tube 110 of a heat pipe structure 100 according to one embodiment of the present invention, and FIG. 2 illustrates the detail structure of the sleeve tube 110 of the heat pipe structure 100. For the purpose of simple explanation, the heat source 200 is not shown in FIG. 2.

As shown in FIG. 2, in this embodiment, the sleeve tube 110 includes an inner wall 120 and an outer wall 150, and the inner wall 120 and the outer wall 150 form a hollow chamber 160 for accommodating a heat transfer fluid. The heat transfer fluid is used to conduct generated heat. For the purpose of simple explanation, the heat transfer fluid is not shown in FIG. 2. In some embodiment, once the shaft 180 connected to the heat source 200 is configured in the sleeve tube 110, the shaft 180 approaches or even partially in contact with the inner wall 120, so that the heat generated by the heat source 200 can be transferred to the heat transfer fluid in the chamber 160, prompting the heat transfer fluid flows or has phase change, thereby taking away the heat generated by the heat source 200 and achieving the purpose of heat dissipation. In some embodiments, the sleeve tube 110 of the heat pipe structure 100 cannot be hollow. The sleeve tube 110 can be made by other material having capability of conducting heat.

As shown in FIG. 2, a plurality of trenches 130 is located on the inner wall 120 of the sleeve tube 110. Four trenches 130 are shown in FIG. 2, but the number of the trenches 130 is not limited by this figure.

Refer to FIG. 1, the sleeve tube 110 of the heat pipe structure 100 has an outlet end, and the shaft 180 connected to the heat source inserts into the sleeve tube 110 from the outlet end. In FIG. 2, the trenches 130 are configured at the outlet end of the sleeve tube 110.

As shown in FIG. 2, each trench 130 extends along the circumferential direction D. The circumferential direction D refers a direction of rotation along the central axis of the sleeve tube 120 (e.g. clockwise direction or counter-clockwise direction along the central axis of the sleeve tube 120). Therefore, once the shaft 180 connected to the heat source 200 inserts into the sleeve tube from the outlet end to form a rotating shaft structure, the trenches 130 can surround the shaft 180 in the circumferential direction D. The purpose that the trenches 130 surround the shaft is to seal the inside of the sleeve tube 110, and the shaft 180 and the sleeve tube 110 of the heat pipe structure 110 can be fixed to form a stable rotating shaft structure. For details, see the following discussion.

In this embodiment, as shown in FIG. 2, a plurality of trenches 130 is located on the inner wall 120 of the sleeve tube 110, and the trenches 130 extend along the circumferential direction and are parallel to each other. In some embodiments, the extending direction of each trench 130 can be different, and the extending directions of the trenches 130 are not parallel to each other. In that case, it is only necessary to keep the extending direction of each trench 130 substantially along the circumferential direction D, and the trenches 130 do not intersect with each other.

As shown in FIG. 2, in this embodiment, the shape of the trench 130 is V-shaped, and the detail structure of the trench 130 refers to following discussion. In addition, the chamber 160 further has capillary structures, which is not shown in FIG. 2 for the sake of simplicity. For the capillary structures in the chamber 160, please refer to the subsequent description of FIG. 3.

Figure 3:
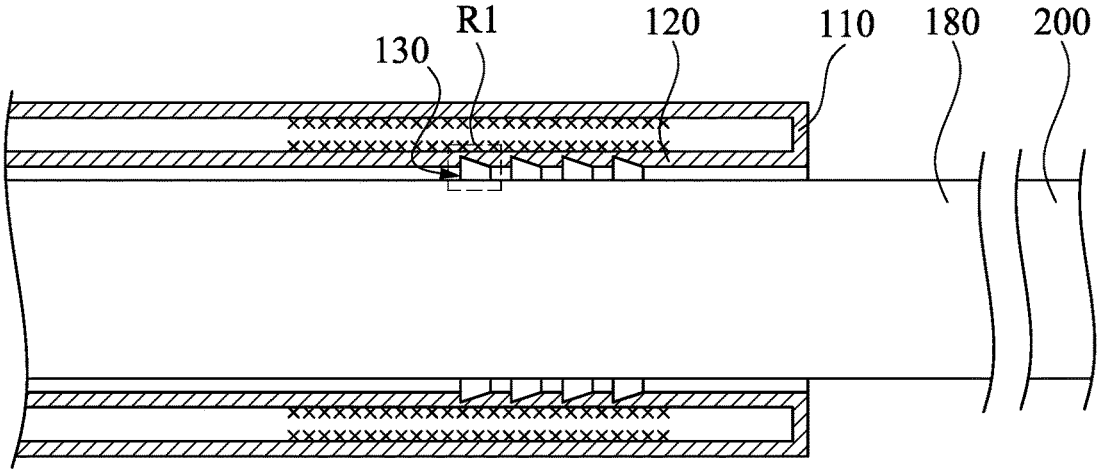
FIG. 3 is a cross-sectional view of a sleeve tube of a heat pipe structure inserted by a shaft connected to a heat source according to one embodiment of the present invention.
Figure 4:
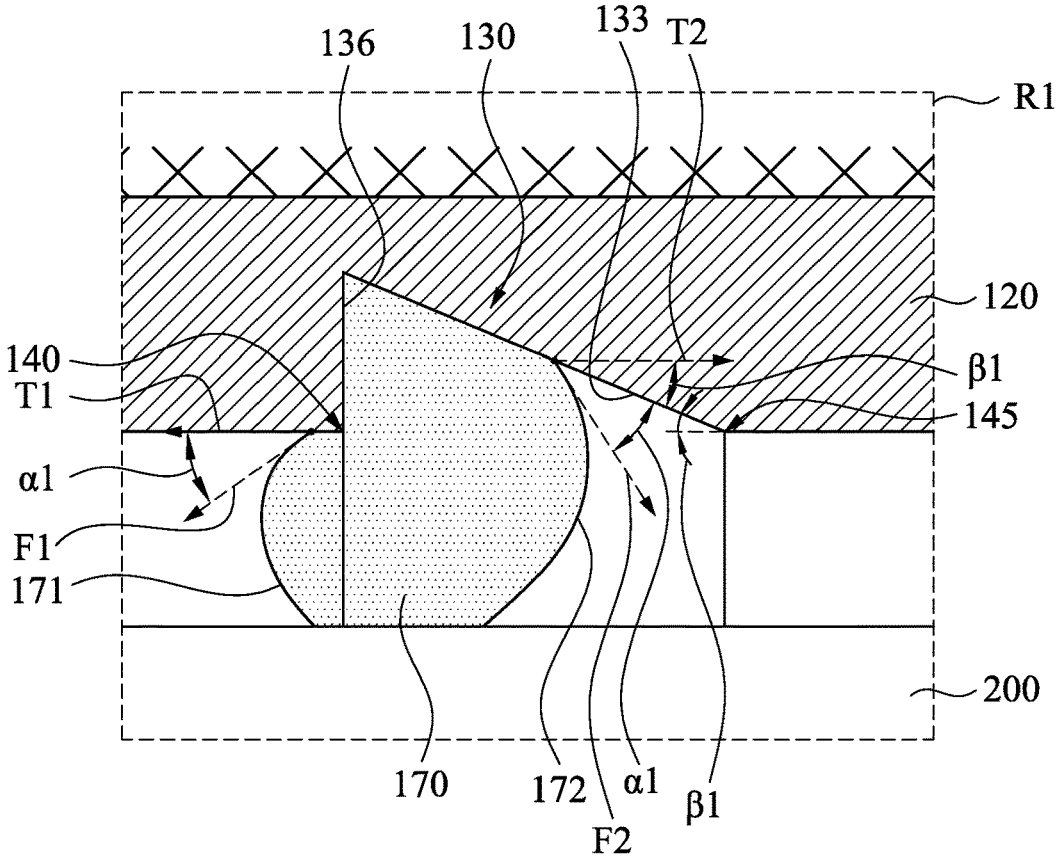
FIG. 4 is a partial enlarged view of FIG. 3, in which a lubricating layer is filled between a trench and the shaft connected to the heat source.

Please refer to FIG. 3 and FIG. 4. FIG. 3 is a cross-sectional view of a sleeve tube 110 of a heat pipe structure 100 inserted by a shaft 180 connected to a heat source 200 according to one embodiment of the present invention. FIG. 4 is a partial enlarged view of FIG. 3, in which a lubricating layer 170 is filled between a trench 130 and the shaft 180 connected to the heat source 200.

In FIG. 3, the shaft 180 connected to the heat source 200 inserts the sleeve tube 110 of the heat pipe structure 100 from the outlet end, such that the trenches 130 approach and surround the shaft 180. Detail structure of the trench 130 in region R1 of FIG. 3 is illustrated in FIG. 4.

In FIG. 3, capillary structures are configured inside the chamber 160. When the heat transfer fluid is contained in the chamber 160, the capillary structures can further assist the flow of heat transfer fluid. Specifically, the capillary structures are configured at surface of the inner wall 120 and the outer wall 150 inside the chamber 160. The heat transfer fluid can flow on the inner wall 120 and the outer wall 150 with capillary structures inside the chamber 160, and the heat transfer fluid can flow in the center of the chamber 160 after the heat transfer fluid have phase change.

As shown in FIG. 4, in this embodiment, the trenches 130 are recessed from the inner wall 120. The trench 130 has a first peripheral edge 140 and a second peripheral edge 145, and the trench 130 is connected to the inner wall 120 by the first peripheral edge 140 and the second peripheral edge 145. The second peripheral edge 145 is closer to the outlet end than the first peripheral edge 140. Refer to FIG. 2 and FIG. 4, in this embodiment, the first peripheral edge 140 and the second peripheral edge 145 are parallel to each other and extend along the circumferential direction D. In other word, the trench 130 is recessed between the first peripheral edge 140 and the second peripheral edge 145. The shape of the trench 130 on the inner wall 120 is a strip with a constant width.

As mentioned above, the shape of the trench 130 is V-shaped. Refer to FIG. 4, in this embodiment, the trench 130 further includes an inclined surface 133 and a vertical surface 136, and the inclined surface 133 and the vertical surface 136 form the V-shaped trench 130.

Further, as shown in FIG. 4, in this embodiment, gaps between the inner wall 120, the trenches 130 and the shaft 180 connected to the heat source 200 can be filled by a lubricating layer 170, and the lubricating layer 170 seals the inside opposite to the outlet end of the sleeve tube 110. The material of the lubricating layer 170 includes lubricating oil or other lubricating fluid. When the shaft 180 connected to the heat source 200 and the sleeve tube 110 of the heat pipe structure 200 form the rotating shaft structure, the lubricating layer 170 maintains the sealing of the inside of the sleeve tube 110 to fix the sleeve tube 110 and the shaft 180 connected to the heat source 200. In addition, the lubricating layer 170 also helps the shaft 180 connected to the heat source 200 to rotate inside the sleeve tube 110.

In FIG. 4, with the first peripheral edge 140 as a boundary, a part of the lubricating layer 170 is located between the trench 130 and the shaft 180 connected to the heat source 200, and another part of the lubricating layer 170 is located between a portion beyond the trench 130 of the inner wall 120 and the shaft 180.

Specifically, the lubricating layer 170 includes a first liquid surface 171 and a second liquid surface 172, and the first liquid surface 171 is opposite to the second liquid surface 172. The first liquid surface 171 and the second liquid surface 172 have edges connected to the shaft 180. As shown in FIG. 4, in this embodiment, the first liquid surface is located between the inner wall 120 and the shaft 180, and the second liquid surface 172 is located between the trench 130 and the shaft 180. That is, the second liquid surface is in contact with the inclined surface 133, and the second liquid surface 172 is located between the inclined surface 133 and the shaft 180.

Further, in this invention, the configuration of the inclined surface 133 is related to the surface tension of the lubricating layer 170.

In this embodiment, the first liquid surface 171 is configured to protrude toward the inside of the sleeve tube 110, and the second liquid surface 172 is configured to protrude toward the outlet end. In other words, the first liquid surface 171 is configured to protrude along a direction opposite to the outlet end. It related to the surface tension of the lubricating layer 170. For the case where the first liquid surface 171 and the second liquid surface 172 are convex, in this embodiment, the inclined surface 133 is configured to extend from the second peripheral edge 145 toward the first peripheral edge 140 at an angle $\beta 1$, so that the inclined surface 133 is connected to the vertical surface 136 extending vertically from the first peripheral edge 140, and the inclined surface 133 and the vertical surface 136 form the V-shaped trench 130.

The surface tension between the lubricating layer 170 and the inner wall 120 can fix the lubricating layer 170 between the sleeve tube 110 and the shaft 180. As shown in FIG. 4, the angle $\alpha 1$ is between the first liquid surface 171 and the inner wall 120, and the same angle $\alpha 1$ is between the second liquid surface 172 and the inclined surface 133.

The surface tension is proportional to the circumference of the liquid surface. Since the depth of the trench 130 is much smaller than the width of the sleeve tube 110, the perimeter of the inner wall 120 in contact with the first liquid surface 171 and the perimeter of the inclined surface 120 in contact with the second liquid surface 172 are approximately the same, and the surface tension F1 corresponding to the first liquid surface 171 and the surface tension F2 of the second liquid surface 172 are approximately the same.

However, the position of the lubricating layer 170 achieves balance according to the axial component of the surface tension. The axial component refers to a component of the surface tension in the axial direction in which the sleeve tube 110 extends. As shown in FIG. 4, the angle between the surface tension F1 of the first liquid surface 171 and the axial direction in which the sleeve tube 110 extends is $\alpha 1$, and the angle between the surface tension F2 of the second liquid surface 172 and the axial direction in which the sleeve tube 110 extends is $\alpha 1+\beta 1$. In this case, the magnitude of the axial component T1 of the surface tension F1 is proportional to the cosine function $\cos(\alpha 1)$, and the magnitude of the axial component T2 of the surface tension F2 is proportional to the cosine function $\cos(\alpha 1+\beta 1)$. The magnitude of the cosine function is basically inversely proportional to the angle when the angle is less than 90 degrees. Therefore, in this embodiment, the axial component T1 of the surface tension F1 is greater than the axial component T2 of the surface tension F2. The lubricating layer 170 shown in FIG. 4 tends to move toward the inside of the sleeve tube 110, and it is less likely to flow out of the outlet end of the sleeve tube 110, so that the gaps between the shaft 180, the inner wall 120 and the trench 130 can be filled by the lubricating layer 170, and the shaft connected to the heat source 200 and the sleeve tube 110 can be fixed.

Therefore, by providing the trench 130 filled with the lubricating layer 170, the sleeve tube 110 of the heat pipe structure 100 and the shaft 180 does not have additional friction, thereby preventing the sleeve tube 110 from being damaged due to insufficient structural rigidity when rotating.

Figure 5:
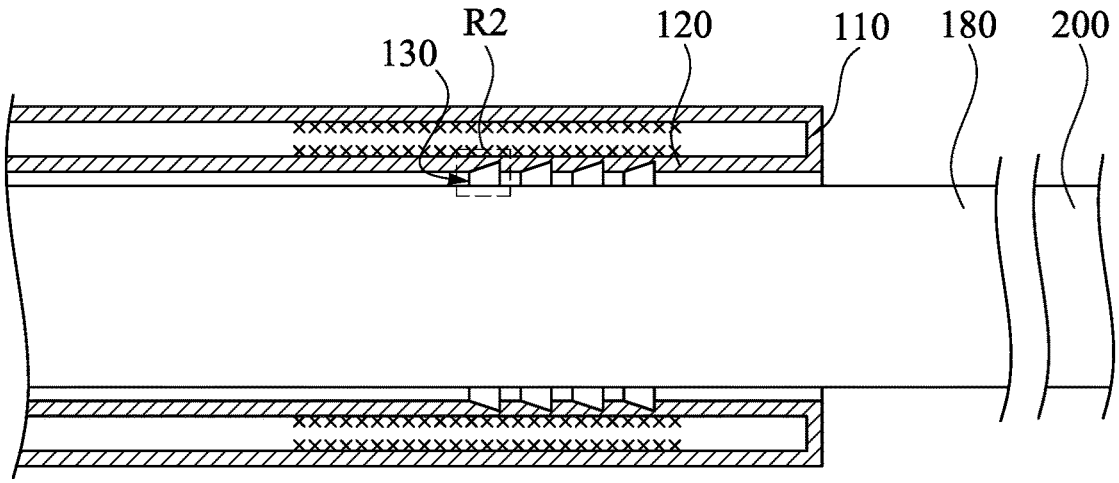
FIG. 5 is a cross-sectional view of a sleeve tube of another heat pipe structure inserted by a shaft connected to a heat source according to one embodiment of the present invention.
Figure 6:
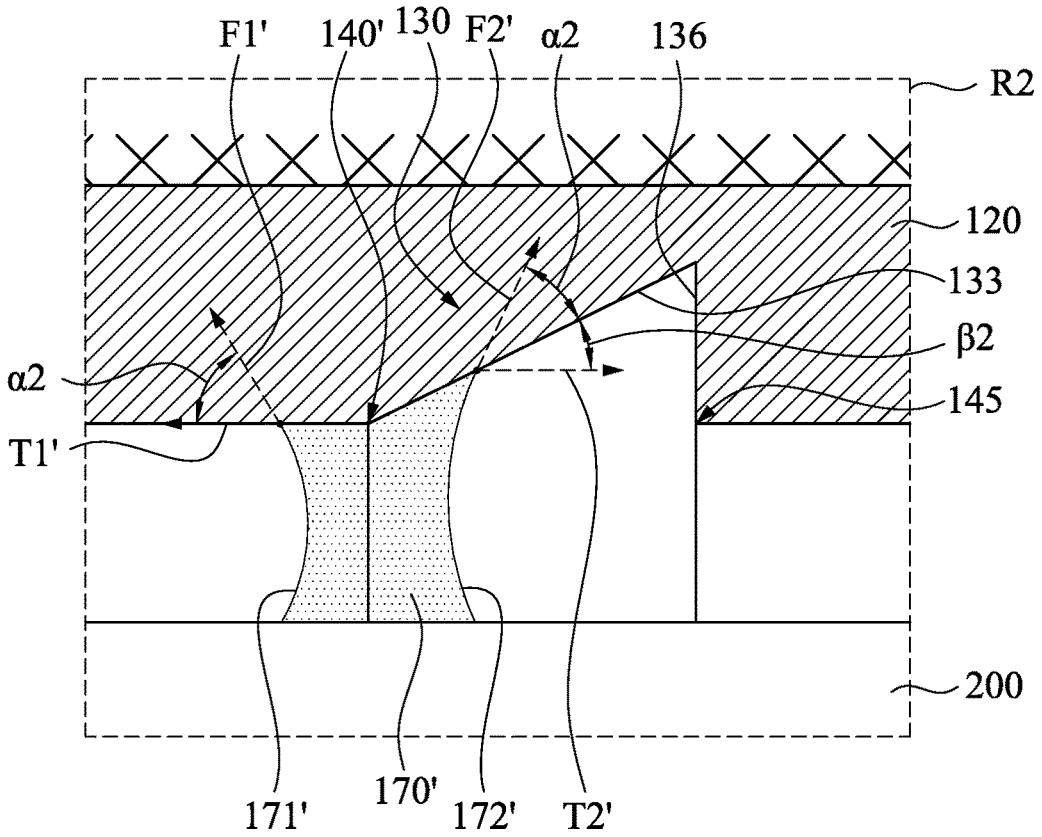
FIG. 6 is a partial enlarged view of FIG. 5, in which a lubricating layer is filled between a trench and the shaft connected to the heat source.

Please refer to FIG. 5 and FIG. 6. FIG. 5 is a cross-sectional view of a sleeve tube 110 of another heat pipe structure inserted by a shaft 180 connected to a heat source 200 according to one embodiment of the present invention. FIG. 6 is a partial enlarged view of FIG. 5, in which a lubricating layer 170' is filled between a trench 130 and the shaft 180 connected to the heat source 200. Detail structure of the trench 130 in region R2 of FIG. 5 is illustrated in FIG. 6.

Similar to FIG. 3, there are capillary structures inside the sleeve tube 110 of the heat pipe structure 110.

Compared with the heat pipe structure 100 in FIG. 3 and FIG. 4, in FIG. 5 and FIG. 6, the inclined surface 133 of the trench 130 is configured to extend from the first peripheral edge 140 toward the second peripheral edge 145 at an angle $\beta 2$, so that the inclined surface 133 is connected to the vertical surface 136 extending vertically from the second peripheral edge 144, and the inclined surface 133 and the vertical surface 136 form the V-shaped trench 130. Both the first liquid surface 171' and the second liquid surface 172' of the lubricating layer 170' are recessed toward the inside of the lubricating layer 170'.

Therefore, as shown in FIG. 6, the angle between the surface tension F1' of the first liquid surface 171' and the axial direction in which the sleeve tube 110 extends is $\alpha 2$, and the angle between the surface tension F2' of the second liquid surface 172' and the axial direction in which the sleeve tube 110 extends is $\alpha 2+\beta 2$. In this case, the magnitude of the axial component T1' of the surface tension F1' is proportional to the cosine function $\cos(\alpha 2)$, and the magnitude of the axial component T2' of the surface tension F2' is proportional to the cosine function $\cos(\alpha 2+\beta 2)$. The axial component T1' of the surface tension F1' is greater than the axial component T2' of the surface tension F2', so that lubricating layer 170' tends to move toward the inside of the sleeve tube 110.

The angle between the first liquid surface 171' and the inner wall 120 is $\alpha 2$, the angle between the second liquid surface 172' and the inclined surface 133 is $\alpha 2$, and the angle between the inclined surface 133 and the axial direction in which the sleeve tube 110 extends is $\beta 2$. In a specific example, the angle $\alpha 2$ is 30 degrees, and the angle $\beta 2$ is also 30 degrees. In this case, the axial component T1' of the surface tension F1' is approximately proportional to the cosine 30 degrees, and the axial component T2' of F2' is approximately proportional to the cosine 60 degrees, then the axial component T1' is greater than the 1.5 times axial component T2'.

In summary, the heat pipe structure of the present invention includes a sleeve tube and a shaft connected to a heat source, and the sleeve tube and the shaft form a rotating shaft structure. An extended trench is provided on the inner wall of the sleeve tube, and the trench has an inclined surface, so that the lubricating layer filled between the trench and the shaft cannot leak out from the outlet end of the sleeve tube due to capillary force caused by the lubricating layer. Accordingly, the inside of the sleeve tube is sealed. The lubricating layer remaining inside the sleeve tube can also lubricate the rotating shaft structure without damaging the shaft and sleeve of the heat pipe structure.

Although the present invention has been described in considerable detail with reference to certain embodiments thereof, it will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A heat pipe structure for cooling a heat source, comprising:

a sleeve tube comprising an inner wall, wherein the sleeve tube has a trench on the inner wall, the trench is at an outlet end of the sleeve tube, and the trench extends in a circumferential direction of the sleeve tube; and a shaft connected to the heat source, wherein the shaft is inserted into the sleeve tube from the outlet end such that the shaft is rotatable relative to the sleeve tube, and the trench surrounds the shaft, wherein the trench is connected to the inner wall by a first peripheral edge and a second peripheral edge, the second peripheral edge is closer to the outlet end than the first peripheral edge, the first peripheral edge and the second peripheral edge are parallel to each other and extend along a circumferential direction of the sleeve tube, and the trench is recessed between the first peripheral edge and the second peripheral edge, wherein the trench comprises an inclined surface, the inclined surface extends at an angle from one of the first peripheral edge and the second peripheral edge.

2. The heat pipe structure of claim 1, wherein the sleeve tube is hollow, the sleeve tube further comprises an outer wall, and the inner wall and the outer wall define a chamber for accommodating a heat transfer fluid.

3. The heat pipe structure of claim 1, wherein the trench further comprises a vertical surface, the vertical surface is perpendicular to the inner wall, the inner wall extends from one of the first peripheral edge and the second peripheral edge, and the vertical surface and the inclined surface form the trench.

4. The heat pipe structure of claim 1, further comprising a lubricating layer between the trench and the shaft configured to fill and seal a gap between the shaft and the sleeve tube.

5. The heat pipe structure of claim 4, wherein a part of the lubricating layer is accommodated in the trench and in contact with the shaft and another part of the lubricating layer is located between the shaft and a part of the inner wall outside the trench.

6. The heat pipe structure of claim 5, wherein the lubricating layer has a first liquid surface and a second liquid surface, the first liquid surface is opposite to the second liquid surface, the first liquid surface and the second liquid surface have edges connected to the shaft, the first liquid surface is disposed between the inner wall outside the trench and the shaft, the second liquid surface is disposed between the inclined surface and the shaft.

7. The heat pipe structure of claim 6, wherein the inclined surface is configured to extend from the second peripheral edge toward the first peripheral edge, the second liquid surface is configured to protrude toward the outlet end, and the first liquid surface is configured to protrude along a direction opposite to the outlet end.

8. The heat pipe structure of claim 6, wherein the inclined surface is configured to extend from the first peripheral edge toward the second peripheral edge, and both the first liquid surface and the second liquid surface are recessed toward the inside of the lubricating layer.

* * * * *